US005560448A

United States Patent [19]

Yemini

[11] Patent Number: 5,560,448

[45] Date of Patent: Oct. 1, 1996

[54] FOLDING SAWHORSE

[75] Inventor: Zvi Yemini, Tel Aviv, Israel

[73] Assignee: Zag Ltd., Tel Aviv, Israel

[21] Appl. No.: 368,126

[22] Filed: Jan. 3, 1995

[51] Int. Cl.[6] ..... B27B 21/00

[52] U.S. Cl. ..... 182/153; 182/225

[58] Field of Search ..... 182/153–155, 182/181–186, 224–227, 151

[56] References Cited

U.S. PATENT DOCUMENTS

| | | | |
|---|---|---|---|
| 1,377,425 | 5/1921 | Milnes, Jr. . | |
| 1,518,886 | 12/1924 | White | 182/181 |
| 2,312,956 | 3/1943 | Campbell . | |
| 3,148,746 | 9/1964 | Juculano . | |
| 3,817,349 | 6/1974 | Barthel . | |
| 4,113,056 | 9/1978 | DeLorenzo . | |
| 4,298,186 | 11/1981 | Glass . | |
| 4,620,613 | 11/1986 | Albertson . | |
| 4,711,319 | 12/1987 | Sansotta et al. . | |
| 5,351,785 | 10/1994 | DuRapau . | |
| 5,467,842 | 11/1995 | Meloy | 182/151 X |

*Primary Examiner*—Alvin C. Chin-Shue

*Attorney, Agent, or Firm*—Mark M. Friedman

[57] ABSTRACT

A folding sawhorse including two bases, each of the two bases having a top and at least one leg, a first plurality of spaced U-shaped coupling elements connected to or formed with the top of the first base, a second plurality of spaced U-shaped coupling elements connected to or formed with the top of the second base, complementary to and staggered relative to the first plurality of coupling elements, the tops of the two bases adjoining one another, with the first and second pluralities of U-shaped coupling elements in interlocking relationship, a rod engaged by the first and second pluralities of U-shaped coupling elements, and cover member extending over the first and second pluralities of U-shaped coupling elements and engaged by the rod to retain the tops of the two bases adjoining one another. In addition, a foldable tray for a sawhorse including first and second tray members each defining first and second edges, the first edges of the first and second tray members being pivotably affixed to the first and second bases, respectively, and the second edges of the first and second tray members being pivotably coupled to one another, the second edges including interdigitated protruding flaps alternating with flap-receiving recesses for partial overlap of the tray members.

15 Claims, 6 Drawing Sheets

FOLDING SAWHORSE

FIELD AND BACKGROUND OF THE INVENTION

The present invention relates to a sawhorse for supporting planks and the like, in general, and, more particularly, to a folding sawhorse which is collapsible for storage and transportation.

Foldable sawhorses for supporting planks and the like have long been known in the art. These generally include two leg-defining bases pivotably coupled by hinges at the top such that the bases can be spread apart in an operative orientation so as to stand on the ground, and can be pivoted towards one another in a folded orientation for transportation and storage.

Such sawhorses are shown, for example, in U.S. Pat. No. 2,312,956 (to Campbell) which shows a collapsible horse including an upper horizontal rail into which the upper ends of the pairs of legs are adapted to extend. Another such sawhorse is described in U.S. Pat. No. 3,148,746 (to Juculano) which includes four tubular legs affixed to cylindrical sleeve elements through which runs a transverse member.

Many of these sawhorses include a shelf extending between the leg sections. For example, U.S. Pat. No. 4,113,056 (to DeLorenzo) shows complementary leg-defining stampings hingedly secured together at the tops thereof and a pair of longitudinally extending shelf sections hingedly connected and projecting inwardly from the lower struts and hingedly fastened together at their inner meeting edges. The edges of the shelf sections include spaced apart bendable sections which are rolled to form hinges, and spaced apart short segments having straight edges abutting one another in the open orientation. Another such sawhorse is shown in U.S. Pat. No. 5,351,785 (to DuRapau) which includes two trestle like frames that are hingedly connected at their tops and a pivoting shelf member which is hingedly attached to a lower strut of one frame and slideably mounted in tracks on the legs of the opposite frame.

Many of these sawhorses suffer from a lack of stability in the legs or the shelf connecting the legs. In addition, they all include at least some metal parts, which can be problematic when the sawhorse is used or stored outdoors.

There is thus a widely recognized need for, and it would be highly advantageous to have, a simple, reliable folding sawhorse which is stable and has a strong tray member when in the operative orientation and which collapses easily to a light-weight compact structure for transportation and storage.

SUMMARY OF THE INVENTION

According to the present invention there is provided a folding sawhorse including two bases, each base having a top and at least one leg, a first plurality of spaced U-shaped coupling elements connected to or formed with the top of the first base, a second plurality of spaced U-shaped coupling elements connected to or formed with the top of the second base, complementary to and staggered relative to the first plurality of coupling elements, the tops of the two bases adjoining one another, with the first and second pluralities of U-shaped coupling elements in interlocking relationship, a rod engaged by the first and second pluralities of U-shaped coupling elements, and a cover member extending over the first and second pluralities of U-shaped coupling elements and engaged by the rod to retain the tops of the two bases adjoining one another.

According to further features in preferred embodiments of the invention described below, the sawhorse further includes a foldable tray including first and second tray members each defining first and second edges, the first edges of the first and second tray members being pivotably affixed to the respective first and second bases, and the second edges of the first and second tray members being pivotably coupled to one another, the second edges including interdigitated protruding flaps alternating with flap-receiving recesses for partial overlap of the first and second tray members.

According to still further features in the described preferred embodiments, each leg also includes a strap receiving aperture and strap retaining pin for receiving and retaining a strap extending between the first and second bases for additional stabilization of the sawhorse in the open orientation.

The present invention successfully addresses the shortcomings of the presently known configurations by providing a stable sawhorse which is easy to manufacture and which includes a particularly stable tray.

BRIEF DESCRIPTION OF THE DRAWINGS

The invention is herein described, by way of example only, with reference to the accompanying drawings, wherein.

Figure 5:
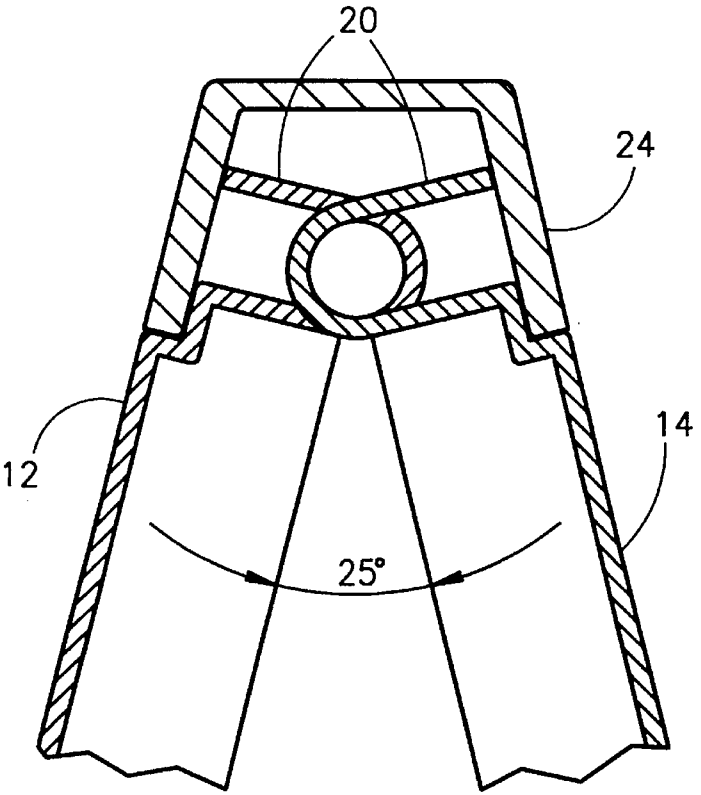
FIG. 5 is an enlarged sectional view of the upper potion of a sawhorse according to one embodiment of the invention.
Figure 7:
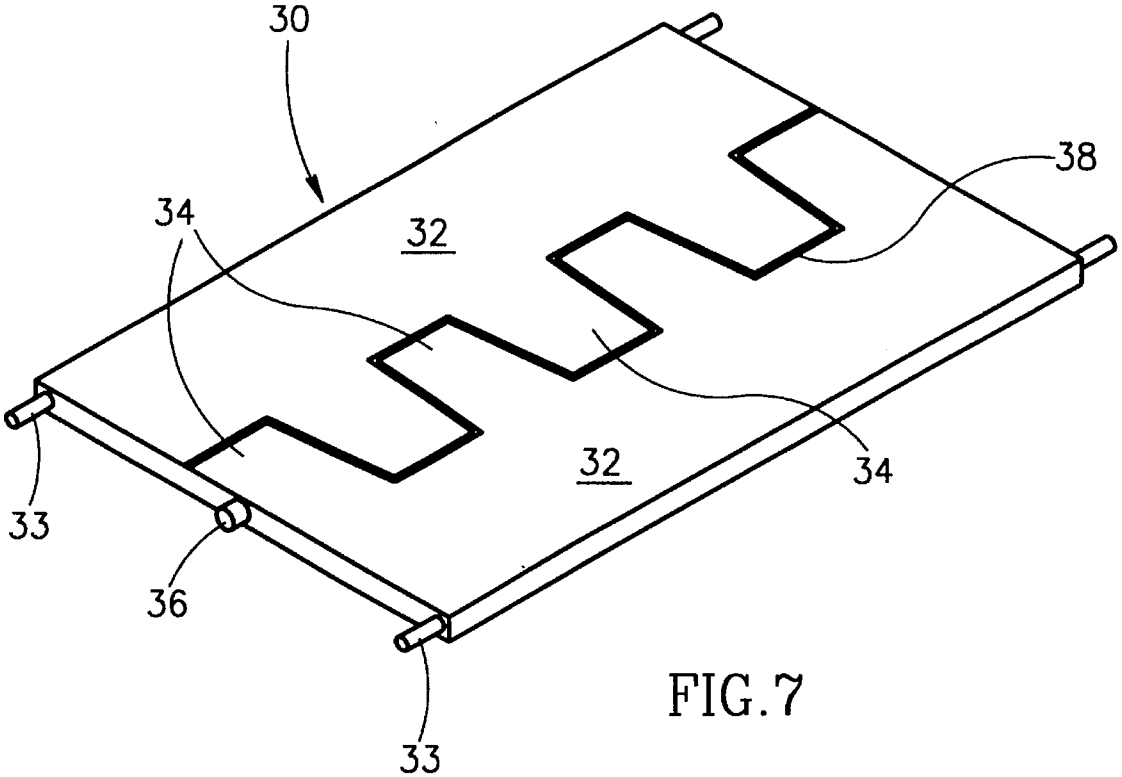
Figure 8:
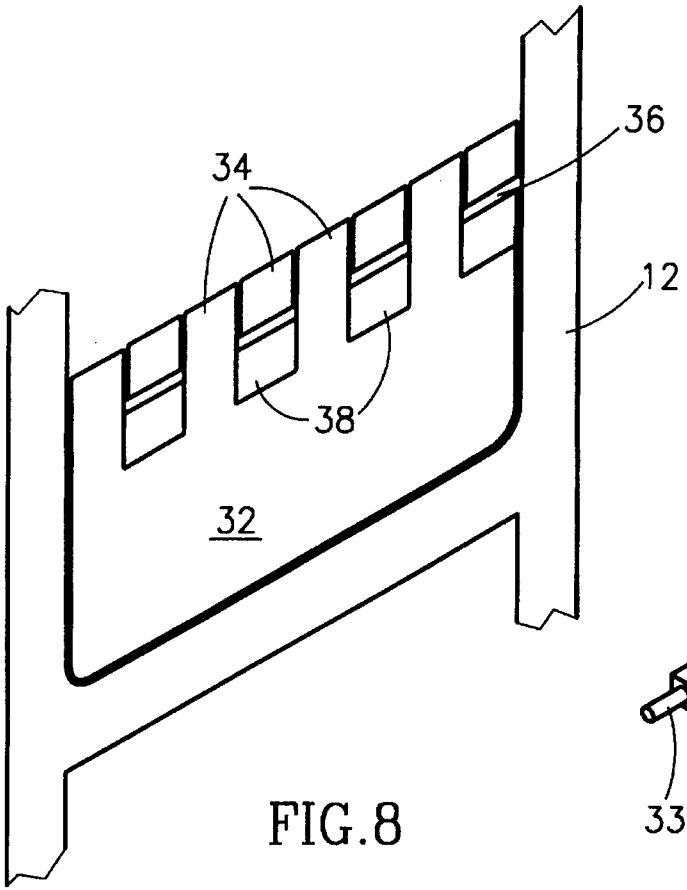

FIG. *6a* is a perspective view of the sawhorse of FIG. 5;

FIG. *6b* is a partially cut away view of a portion of FIG. *6a*;

FIG. 7 is an enlarged schematic view of the tray in a sawhorse according to one embodiment of the present invention in the operative orientation; and FIG. 8 is a schematic view of the tray of FIG. 7 in a folded orientation.

DESCRIPTION OF THE PREFERRED EMBODIMENTS

The present invention relates to a folding sawhorse which can be easily folded and carried and which is particularly strong and stable when in the open orientation. In particular, the sawhorse has a folding tray member which includes interdigitated flaps which overlap in the open orientation to provide a particularly stable construction.

The principles and operation of a sawhorse according to the present invention may be better understood with reference to the drawings and the accompanying description.

Figure 1:
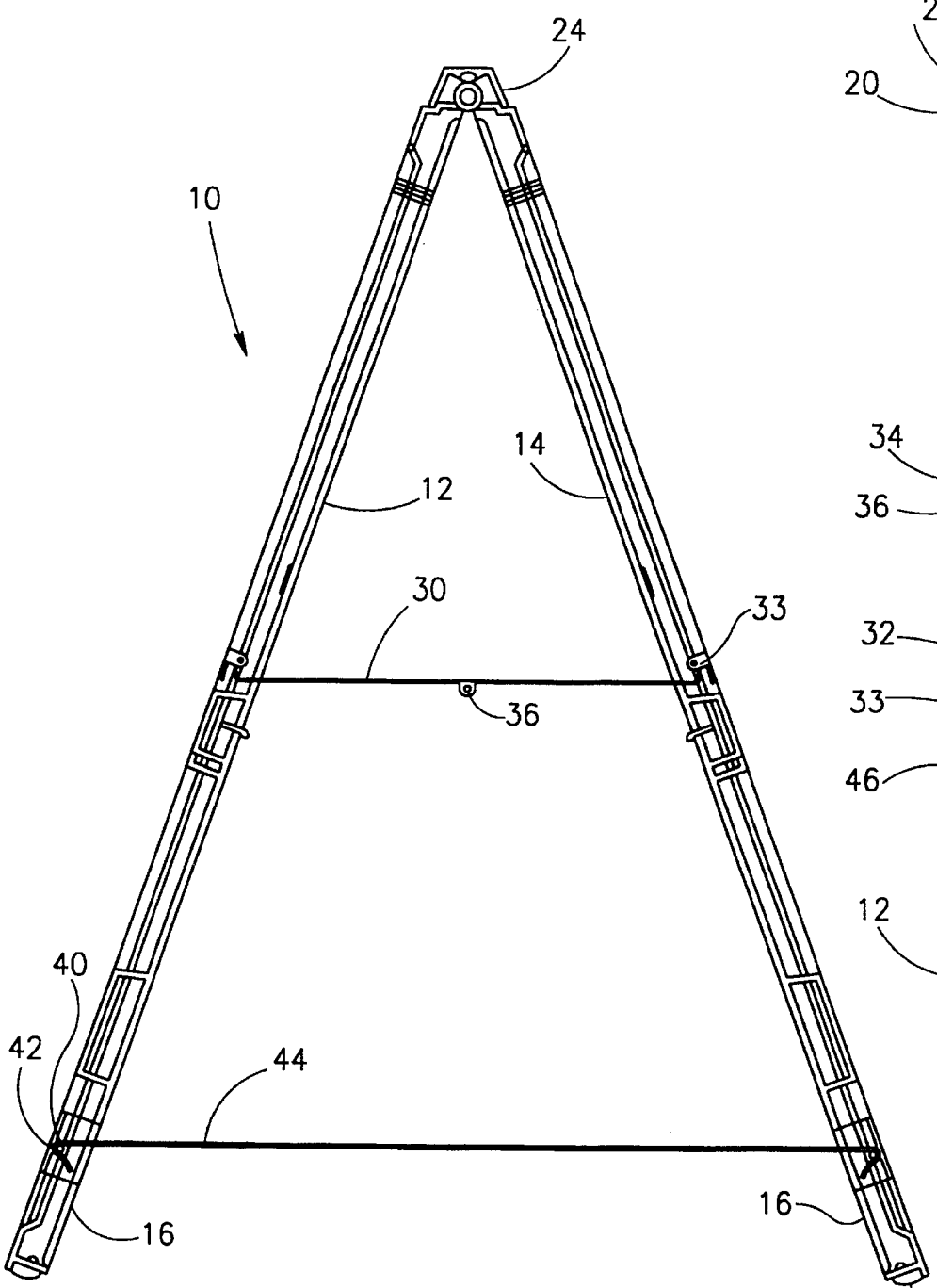
FIG. 1 is a side view of a sawhorse constructed and operative in accordance with one embodiment of the invention in the open orientation.
Figure 3:
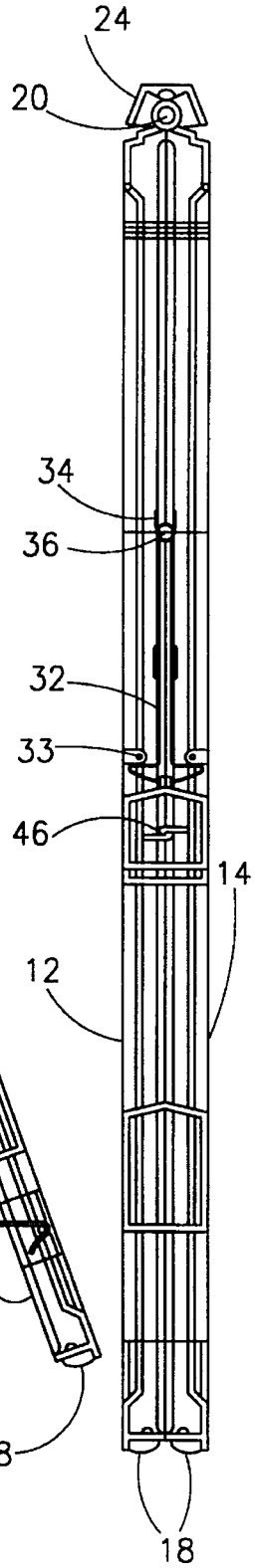
FIG. 3 is a side view of the sawhorse of FIG. 1 in the closed orientation.
Figure 2:
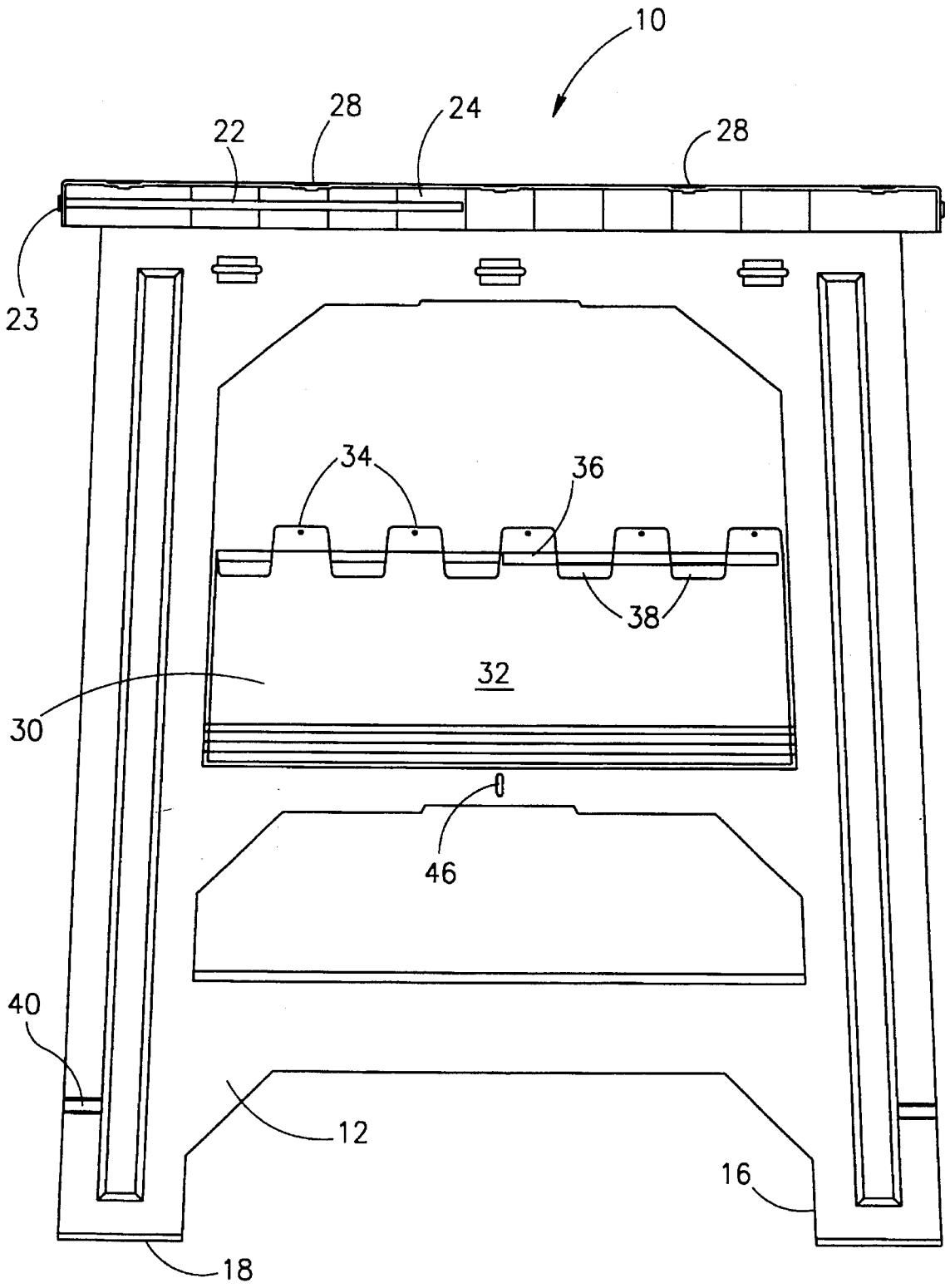
FIG. 2 is a front view of the sawhorse of FIG. 1.

Referring now to the drawings, FIGS. 1, 2 and 3 illustrate a sawhorse, generally designated 10, constructed and operative in accordance with a preferred embodiment of the present invention in respective side sectional and front views in the open orientation and side sectional view in the closed orientation. The sawhorse 10 includes a pair of bases 12 and 14 which define the legs 16 of the sawhorse. The bottoms of legs 16 are preferably covered with a layer 18 of rubber, preferably TPR (thermoplastic rubber) to prevent slipping.

Figure 4:
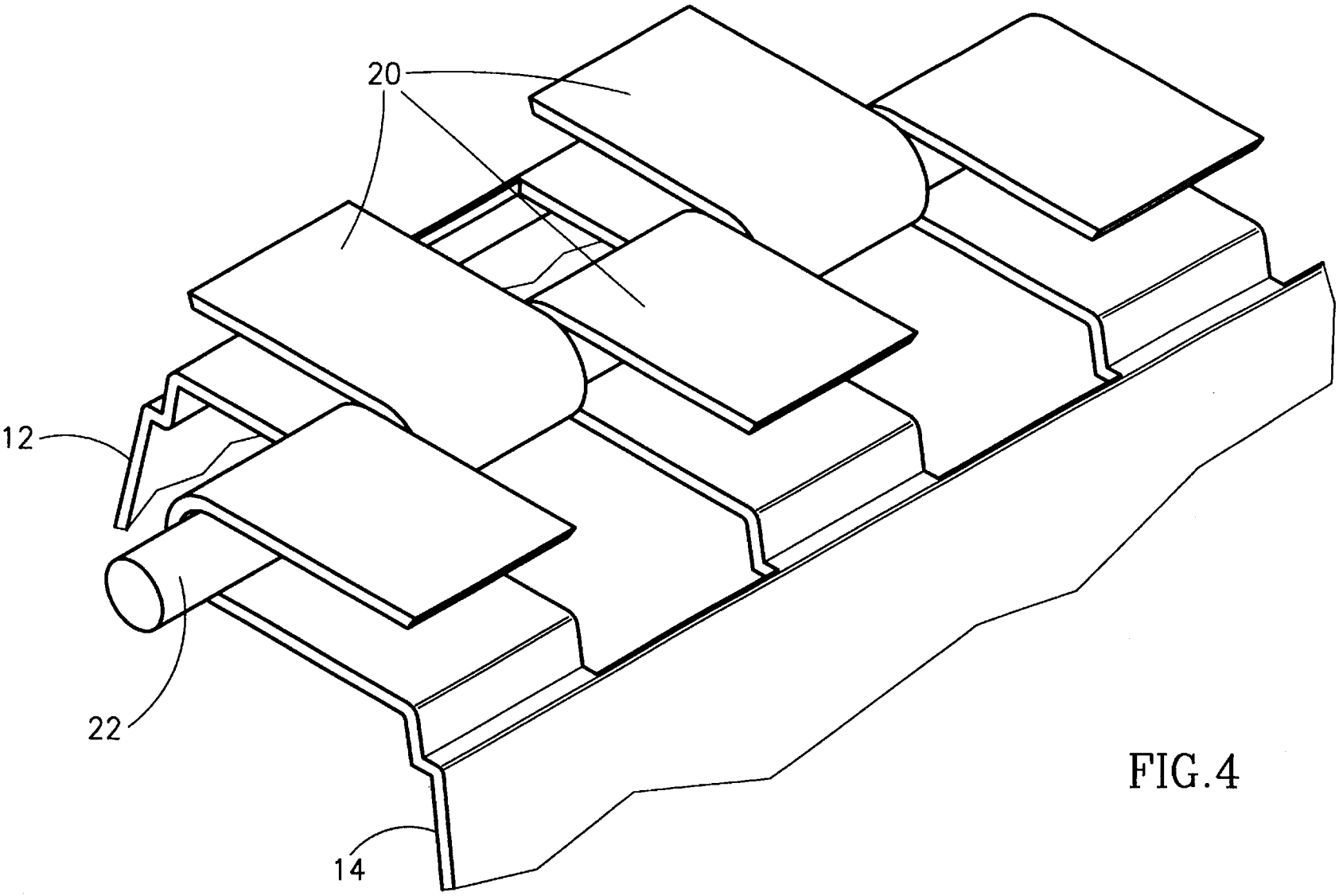
FIG. 4 is a schematic view of the interengagement of the two bases in a sawhorse according to the invention.

Bases 12 and 14 are coupled to each other at the tops thereof by a plurality of U-shaped coupling elements 20, shown in greater detail in FIGS. 4 and 5. Coupling elements 20 are preferably integrally formed with bases 12 and 14. The U-shaped coupling elements 20 on base 12 are staggered in relation to the U-shaped coupling elements 20 on base 14 and interlock therewith along the length of the sawhorse. A rod 22 is engaged by the U-shaped coupling elements to hold bases 12 and 14 close to one another. Preferably, a protective button 23, such as of thermoplastic rubber, is provided covering the end of rod 22 to act as a shock absorber if the sawhorse falls or is placed on its side.

Figure 6A:
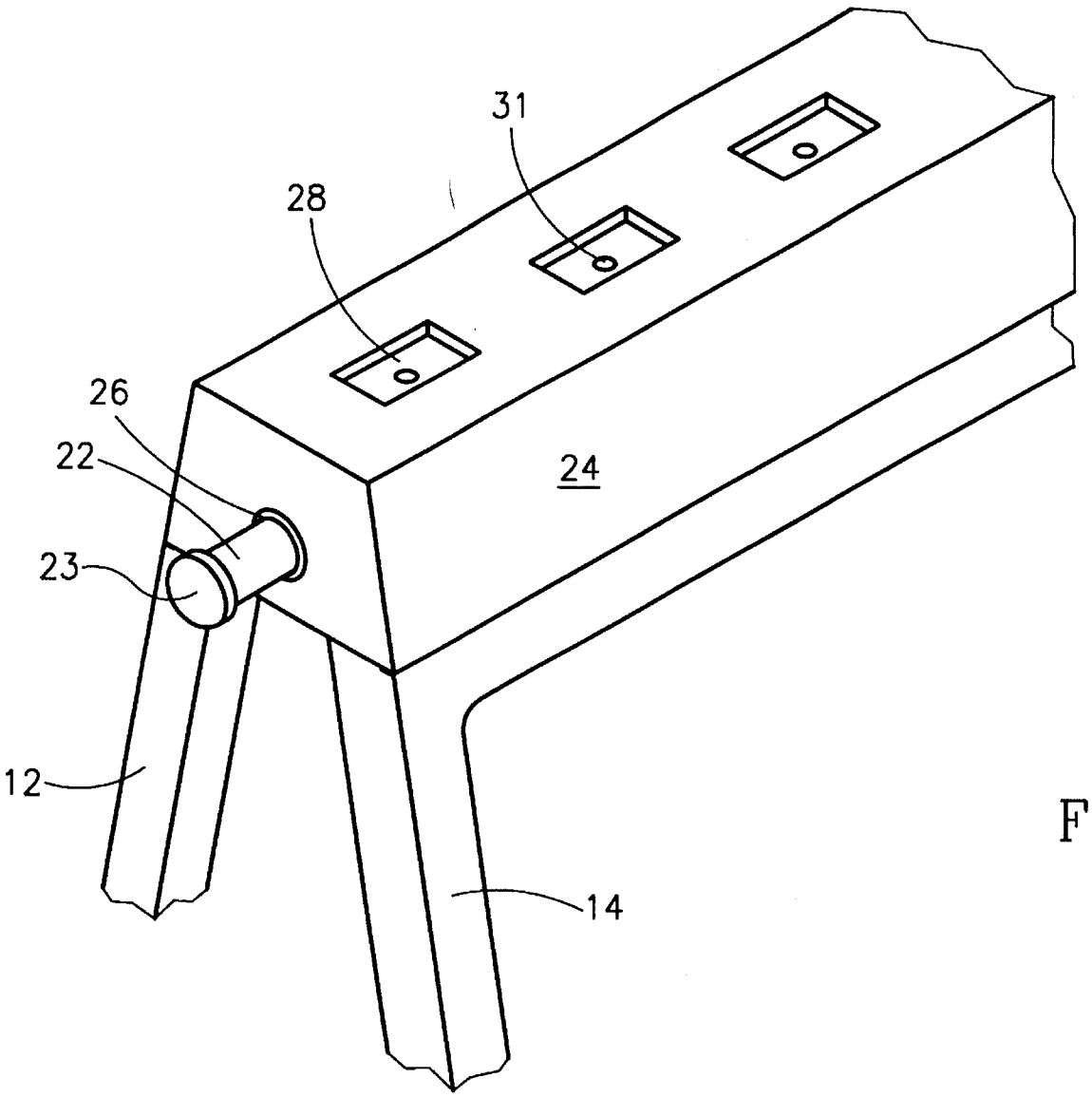

A cover member 24, seen in FIGS. 5 and 6, covers the interlocked U-shaped coupling elements 20. It is a particular feature of the invention that cover member 24 prevents the movement of bases 12 and 14 away from one another while providing a stable work surface on which work pieces rest. In this fashion, the cover member serves to strengthen the sawhorse, relative to conventional sawhorses.

Figure 6B:
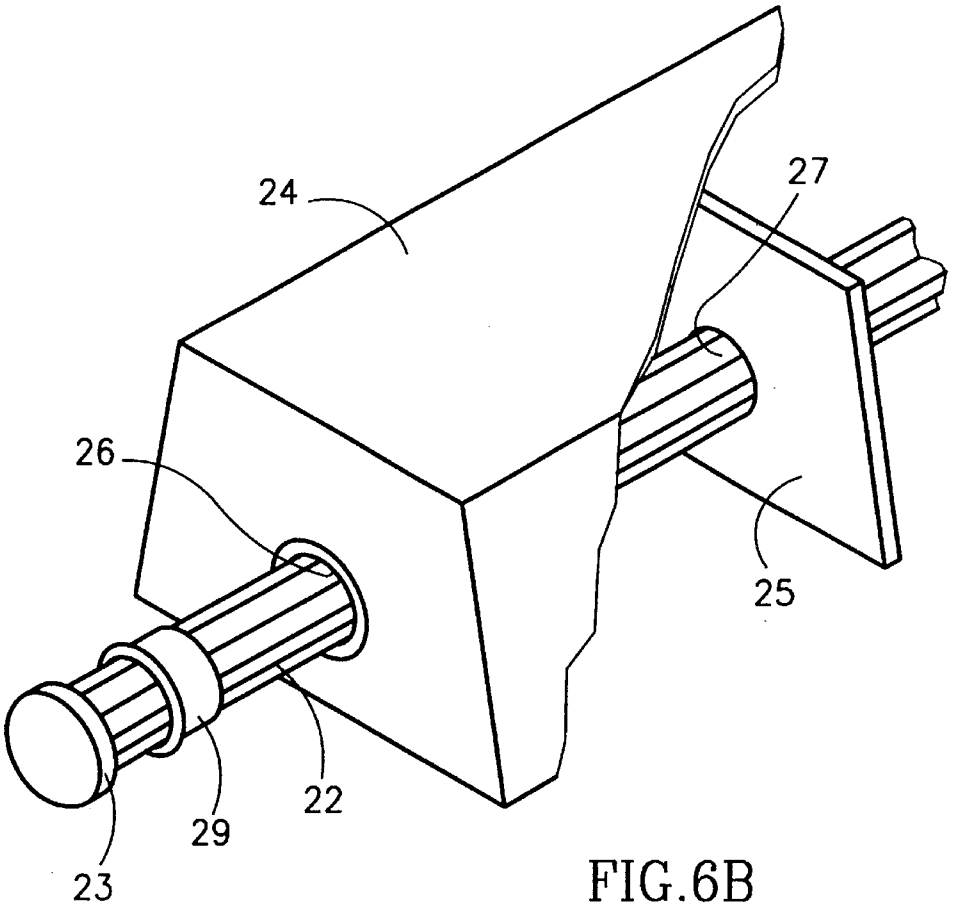

Cover member 24 preferably includes at least one internal depending rib 25, seen best in FIG. 6*b*, which fits between two adjacent U-shaped coupling elements. Rib 25 includes an aperture 27 in register with the U-shaped coupling elements. Rod 22 extends through opposed apertures 26 in cover member 24, through U-shaped coupling elements 20 and through aperture 27 in rib 25. Rod 22 is engaged at its ends by cover member 24 and preferably includes a snap-lock element 29 to retain it in place in aperture 26. According to one embodiment, for ease of assembly, rod 22 consists of two rods which are inserted through cover member 24 and U-shaped coupling elements 20 from each end of the sawhorse and abut in the middle.

According to a preferred embodiment of the invention, cover member 24 includes a plurality of recesses 28 in the upper surface thereof. Preferably, recesses 28 have apertures 31 in the bottom thereof where various accessories can be affixed, as by bolts. Blocks of rubber, such as TPR, are preferably disposed in apertures 28 thereby preventing sliding of workpieces placed on the sawhorse. This is especially important when two sawhorses are used to form a trestle table and a plank or workpiece is placed across them. The blocks of rubber can be removed and recesses 28 can be utilized, i.e. for storage or to engage add-on accessories, as desired.

With further reference to FIGS. 1–3, the sawhorse further includes a folding tray 30. Tray 30 includes two tray members 32 pivotably coupled at one edge thereof to bases 12 and 14 about pins 33. Preferably, pins 33 are molded as integral parts of the tray members. The other edge of tray members 32 include a plurality of spaced flaps 34 which interdigitate with the flaps 34 of the opposing tray member. A pin 36 passes through flaps 34 of both tray members 32 for pivotal folding of the tray members relative to one another.

Tray 30 is shown in greater detail in FIGS. 7 and 8. In these drawings, the interdigitation of flaps 34 can be seen more clearly. In registration with each flap 34 on the opposing tray member 32 there is provided a shallow recess 38 in which that portion of flap 34 which protrudes beyond pin 36 seats in the open orientation. It is a particular feature of the present invention that the opposing tray members partially overlap, thereby strengthening tray 30 and providing additional stability to the sawhorse in the open orientation.

Additional preferred features of the invention can be seen with further reference to FIGS. 1 to 3. These include four strap receiving apertures 40, one in each of legs 16. A strap retaining pin 42 for affixing a strap thereto is preferably provided adjacent each aperture 40. Apertures 40 and pins 42 are arranged for receiving and retaining straps 44, one extending on either side of the sawhorse between base 12 and base 14. (See FIG. 1) Straps 44 serve to further stabilize the sawhorse and to prevent bases 12 and 14 from opening too far under a load.

Preferably the sawhorse includes a locking mechanism 46 coupled to bases 12 and 14, preferably a snap-lock, for locking the sawhorse in the folded orientation to prevent inadvertent opening during transportation or storage.

Further according to a preferred embodiment, cover member 24 has scales, such as Imperial and Metric scales, molded into it.

The sawhorse of the present invention may be formed of any suitably strong yet lightweight plastic material. Preferably, it is formed of heavy-duty, recyclable polyolefins, such as polypropylene and polyethylene. It is a particular feature of the invention that the entire sawhorse, including rod 22 can be formed of plastic material. This provides a weather resistant sawhorse which does not rust and which can be used or stored outdoors as well as indoors.

While the invention has been described with respect to a limited number of embodiments, it will be appreciated that many variations, modifications and other applications of the invention may be made.

What is claimed is:

1. A folding sawhorse comprising:

(a) two bases, each of said two bases having a top and at least one leg;

(b) a first plurality of spaced U-shaped coupling elements connected to or formed with said top of said first base;

(c) a second plurality of spaced U-shaped coupling elements connected to or formed with said top of said second base, complementary to and staggered relative to said first plurality of coupling elements;

(d) said tops of said two bases adjoining one another, with said first and second pluralities of U-shaped coupling elements in interlocking relationship;

(e) a rod engaged by said first and second pluralities of U-shaped coupling elements; and (f) a cover member extending over said first and second pluralities of U-shaped coupling elements and engaged by said rod to retain said tops of said two bases adjoining one another.

2. The sawhorse of claim 1, further comprising a foldable tray pivotably coupled between said two bases.

3. The sawhorse of claim 2, wherein said foldable tray includes:

(a) first and second tray members, each defining first and second edges;

(b) said first edges of said first and second tray members being pivotably affixed to said first and second bases, respectively;

(c) said second edges of said first and second tray members being pivotably coupled to one another, said second edges including interdigitated flaps.

4. The sawhorse of claim 3, wherein said second edges of said first and second tray members include interdigitated protruding flaps alternating with flap-receiving recesses for partial overlap of said first and second tray members.

5. The sawhorse of claim 1, further comprising a strap receiving aperture and strap retaining pin in each of said legs for receiving and retaining a strap extending between said first and second bases.

6. The sawhorse of claim 1, wherein said cover member includes an upper surface having a plurality of recesses.

7. The sawhorse of claim 6, further comprising a plurality of rubber elements seated in said plurality of recesses.

8. The sawhorse of claim 6, wherein each of said recesses includes an aperture in the bottom thereof.

9. The sawhorse of claim 1, further comprising locking apparatus associated with said two bases for locking the sawhorse in a folded orientation.

10. The sawhorse of claim 9, wherein said locking apparatus includes a snap-lock apparatus.

11. The sawhorse of claim 1, further comprising a snap-lock apparatus on said rod for engaging said cover member.

12. The sawhorse of claim 1, further comprising a protective button mounted on each end of said rod.

13. The sawhorse of claim 12, wherein said protective button includes thermoplastic rubber.

14. The sawhorse of claim 1, further comprising means on said at least one leg for preventing slipping.

15. The sawhorse of claim 14, wherein said means for preventing slipping includes thermoplastic rubber.

* * * * *